US008926285B2

(12) United States Patent
Richter

(10) Patent No.: US 8,926,285 B2
(45) Date of Patent: Jan. 6, 2015

(54) TURBINE BLADE FASTENING FOR A TURBOMACHINE

(75) Inventor: Christoph Hermann Richter, Ibbenbüren (DE)

(73) Assignee: Siemens Aktiengesellschaft, Munich (DE)

( * ) Notice: Subject to any disclaimer, the term of this patent is extended or adjusted under 35 U.S.C. 154(b) by 266 days.

(21) Appl. No.: 13/510,086

(22) PCT Filed: Nov. 16, 2010

(86) PCT No.: PCT/EP2010/067582
§ 371 (c)(1),
(2), (4) Date: May 16, 2012

(87) PCT Pub. No.: WO2011/061193
PCT Pub. Date: May 26, 2011

(65) Prior Publication Data

US 2012/0224971 A1 Sep. 6, 2012

(30) Foreign Application Priority Data

Nov. 17, 2009 (EP) ..... 09014382

(51) Int. Cl.
*F01D 5/30* (2006.01)

(52) U.S. Cl.
CPC ..... *F01D 5/3007* (2013.01); *F05D 2250/70* (2013.01); *F05D 2250/314* (2013.01)
USPC ..... 416/219 R

(58) Field of Classification Search
CPC ..... F01D 5/3007; F01D 5/323; F01D 5/326
USPC ..... 416/219 R, 220 R, 221, 239, 248, 416/215–218
See application file for complete search history.

(56) References Cited

U.S. PATENT DOCUMENTS

| | | | | | |
|---|---|---|---|---|---|
| 3,079,681 | A | * | 3/1963 | Fentiman | 416/219 R |
| 4,824,328 | A | * | 4/1989 | Pisz et al. | 416/219 R |
| 5,110,262 | A | | 5/1992 | Evans | |
| 5,147,180 | A | * | 9/1992 | Johnson | 416/219 R |
| 5,160,242 | A | | 11/1992 | Brown | |
| 5,431,543 | A | * | 7/1995 | Brown et al. | 416/221 |
| 6,435,833 | B1 | | 8/2002 | Chiu | |

FOREIGN PATENT DOCUMENTS

| | | | |
|---|---|---|---|
| CH | 240283 | A | 12/1945 |
| CN | 88103013 | A | 12/1988 |
| CN | 2809222 | Y | 8/2006 |
| CN | 201103424 | Y | 8/2008 |
| DE | 2512347 | A1 | 10/1975 |
| EP | 0635623 | A1 | 1/1995 |
| EP | 1905954 | A1 | 4/2008 |
| GB | 677142 | A | 8/1952 |
| JP | 562271903 | A | 11/1987 |
| JP | 3182603 | B2 | 7/2001 |
| JP | 2002242609 | A | 8/2002 |

* cited by examiner

*Primary Examiner* — Christopher Verdier

(57) ABSTRACT

A turbine blade fastening is provided. The turbine blade fastening include a blade root implemented in a fir tree design, which includes anchoring teeth implemented toward the blade casting tip such that the height of the anchoring teeth is reduced toward the blade casting tip. The anchoring teeth are designed for fitting into corresponding recesses in a rotor.

8 Claims, 2 Drawing Sheets

TURBINE BLADE FASTENING FOR A TURBOMACHINE

CROSS REFERENCE TO RELATED APPLICATIONS

This application is the US National Stage of International Application No. PCT/EP2010/067582, filed Nov. 16, 2010 and claims the benefit thereof. The International Application claims the benefits of European Patent Office application No. 09014382.7 EP filed Nov. 17, 2009. All of the applications are incorporated by reference herein in their entirety.

FIELD OF INVENTION

The invention refers to a turbine blade fastening, comprising a blade root, a blade airfoil and a blade groove, wherein the blade root is arranged in the blade groove, wherein the blade root comprises at least two anchoring teeth which are designed for fitting into corresponding recesses in a rotor.

BACKGROUND OF INVENTION

In turbomachines, especially steam turbines, the energy of a flow medium is converted into rotational energy of a rotor. For this purpose, the rotor comprises a plurality of turbine blades which are formed in such a way that the thermal energy of the flow medium is converted into rotational energy of the rotor. In the case of steam turbines, the flow medium is steam.

The turbomachines furthermore also comprise turbine blades which are attached to the casing, in addition to the turbine blades which are arranged on the rotor. The turbine blades which are arranged on the rotor are referred to as turbine rotor blades and the turbine blades which are arranged on the casing are referred to as turbine stator blades. The turbine rotor blades have blade roots via which the turbine rotor blades are fastened on the rotor. To this end, the blade roots are designed in such a way that they engage in corresponding recesses inside the rotor. The inner contour of the recess corresponds to the outer contour of the blade roots in this case. In principle, two blade root designs are known, namely the firtree design and the dovetail design.

The cross sectional contour of the blade root in the case of the firtree design has a leading region in the rotational direction of the turbine rotor blade and a trailing region in the rotational direction, which is characterized by a wave-like contour. The projections of such a wave-like contour form a plurality of anchoring teeth in the two regions. The turbine rotor blades are inserted by the blade roots into corresponding recesses inside the rotor. To this end, the rotor has a wave-like contour which corresponds to the blade root.

The rotor, together with the turbine rotor blades, rotates during operation at a comparatively high frequency of 50 Hz or 60 Hz, for example. It is also known that steam turbines are operated at higher rotational speeds for corresponding applications. At the high temperatures and rotational speeds which arise during operation, enormous thermal and mechanical loads occur. In particular, the blade roots of the turbine rotor blades are mechanically heavily loaded. It is possible that the vibrations of the turbine rotor blades, which occur during operation and are transferred onto the blade roots, lead to cracks in the turbine rotor blades or in the corresponding recesses of the rotor. If such a crack emerges, there is a high probability that as a result of crack propagation the crack increases further and in the worst case can lead to damage in the entire turbomachine if such a turbine blade becomes detached from the rotor during operation and creates damage in the casing, for example.

It would be desirable to have a blade root design in which even in the case of a crack developing the crack propagation is minimized.

SUMMARY OF INVENTION

The invention comes in at this point, the object of which is to disclose a blade root fastening in which the propagation of a crack is delayed.

This object is achieved by means of a turbine blade fastening, comprising a blade root, a blade airfoil and a blade groove, wherein the blade root is arranged in the blade groove, wherein the blade root comprises at least two anchoring teeth which are designed for fitting into corresponding recesses in a rotor, wherein the height of the anchoring teeth increases towards the blade root tip.

Advantageous developments are disclosed in the dependent claims

The invention is based on the idea of moving away from the known blade root design for firtree roots. At present, the anchoring teeth are designed in such a way that the height of the anchoring teeth decreases towards the blade root tip. In this case, the spatial extent in the circumferential direction is to be understood by the height of the anchoring teeth. In the blade root design according to the prior art, the anchoring teeth are designed in a wave-like contour. The height of the anchoring teeth varies in this case in such a way that the height decreases from anchoring tooth to anchoring tooth towards the blade root tip so that the last anchoring tooth at the blade root tip has the smallest height and the first anchoring tooth, which is arranged in the proximity of the surface of the rotor, has the greatest height.

The invention is now based on a completely different design, according to which from now onwards the height still also varies from anchoring tooth to anchoring tooth but the height of the anchoring teeth increases towards the blade root tip. This results in the anchoring tooth which is arranged at the blade root tip having the greatest height and the anchoring tooth lying closest to the rotor surface having the smallest height.

According to calculations, such a blade root design results in the effect that with development of a crack at a point in the blade root an alternative stress path is created, which reduces the stresses around the existing crack. This leads to the stresses in the surrounding area of the crack being reduced, wherein the stresses in the regions outside the crack are increased. The loading of the anchoring teeth which are not affected by the crack therefore increases. Since the stresses at the crack are minimized, a further growth of the crack is therefore almost prevented or minimized.

In an advantageous development, the anchoring teeth have an anchoring-tooth apex, wherein the anchoring-tooth apexes are arranged essentially along an apex straight line.

The new design is distinguished by a wave-like contour, wherein the anchoring teeth virtually represent a wave crest, and wave troughs are formed between the anchoring teeth. The anchoring teeth have an anchoring-tooth apex at their tip, wherein the anchoring-tooth apexes of the individual anchoring teeth are arranged along the apex straight line.

In a further advantageous development, an anchoring-tooth trough apex is formed between the anchoring teeth in each case, wherein the anchoring-tooth trough apexes are arranged essentially along a trough straight line. This means that the anchoring-tooth trough apexes, which are arranged in each case between the anchoring teeth, are arranged along an imaginary line which lies on the trough straight line.

This design leads to redundant stress paths being created as soon as a crack develops in the blade root.

In a further advantageous development, the apex straight line in relation to the trough straight line is arranged at an angle of between 2° and 10°, especially between 1° and 12°. Within this range of angles, the stress distribution during operation is optimum.

In a further advantageous development, the length of the anchoring teeth increases towards the blade tip. Also in this case, in contrast to the existing design in the prior art, the length of the anchoring teeth is varied in such a way that the length increases towards the blade root tip. As described in the prior art, the length of the anchoring teeth usually decreases towards the blade root tip. The thus acquired blade root design therefore has a plurality of anchoring teeth, the size of which increases from the rotor surface towards the blade root tip.

In a further advantageous development, the anchoring tooth has a flank between the anchoring-tooth trough apex and the anchoring-tooth apex, wherein an inner notch radius is formed between the anchoring-tooth trough apex and the flank and an outer notch radius is formed between the flank and the anchoring-tooth apex, wherein the outer notch radius is larger than the inner notch radius.

In the new blade root design, the forces are to act as far as possible in the blade root in such a way that in the event of a crack, crack propagation is stopped. Particularly in the notch radii, mechanical stresses, from experience, are high so that according to the invention the outer notch radius is smaller than the inner notch radius.

In a further advantageous development, a load-bearing flank clearance is formed between the flank and a corresponding load-bearing flank in the blade groove, wherein the load-bearing flank clearance at the anchoring tooth which is closest to the blade root tip is minimal, which therefore means that initially, during installation, the anchoring tooth bears against the blade groove at this point and the load-bearing flank clearances increase towards the blade airfoil.

BRIEF DESCRIPTION OF THE DRAWINGS

The invention is explained in more detail based on an exemplary embodiment in the figures. In the figures.

DETAILED DESCRIPTION OF INVENTION

Figure 1:
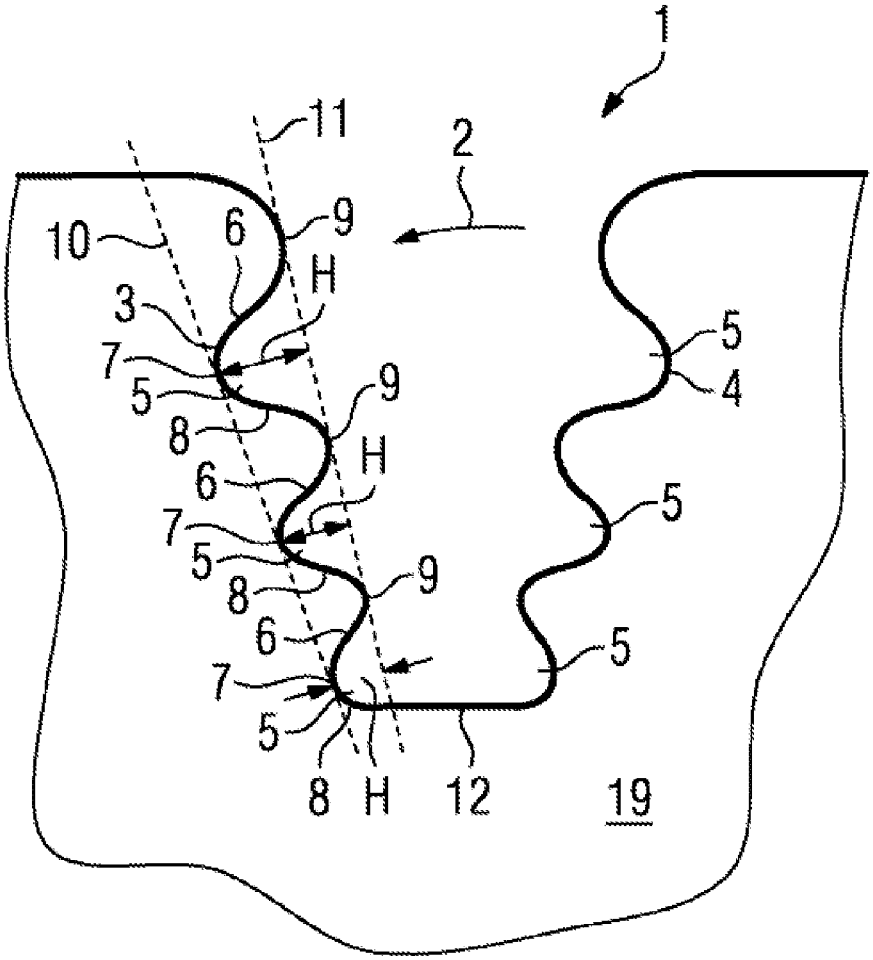
FIG 1 (Prior Art)
FIG. 1 shows a blade root design according to the prior art.

FIG. 1 shows a detail of a turbine blade, comprising a blade root 1 and a blade airfoil, which is not shown in more detail. The blade root 1 according to FIG. 1 is constructed in the so-called firtree design and forms the prior art. Such a blade root 1 has a leading region 3 in the direction of rotation (arrow 2) and a trailing region 4 in the direction of rotation. The blade root 1 according to FIG. 1 has three anchoring teeth 5 both in the leading region 3 and in the trailing region 4. The anchoring teeth 5 engage in a correspondingly contoured recess inside a rotor, which is not shown in more detail, as a result of which the turbine blade is fastened on the rotor via the blade root 1.

The blade root 1 which is shown in FIG. 1 is of an essentially symmetrical design, i.e. such that the contour of the anchoring teeth 5 is of an essentially identical design in the leading region 3 and in the trailing region 4. The anchoring teeth 5 are designed for fitting into corresponding recesses in a rotor. Each anchoring tooth 5 has a height H. The anchoring tooth 5 has an ascending flank 6, an anchoring-tooth apex 7 and a descending flank 8. The contour of the blade root 1 can therefore be described as being wave-like, wherein an anchoring-tooth trough apex 9 is arranged between each anchoring-tooth apex 7. The anchoring-tooth apexes 7 of the individual anchoring teeth 5, in the example selected in FIG. 1, lie in a line on an apex straight line 10. Opposite it, the anchoring-tooth trough apexes 9 of the respective troughs between the anchoring teeth 5 lie on a line along a trough straight line 11.

The height H of an anchoring tooth 5 can be determined in a first approximation as follows: The shortest distance between the anchoring-tooth apex 7 and the trough straight line 11.

According to the prior art, the height H of the anchoring teeth 5 decreases towards the blade root tip 12.

Figure 2:
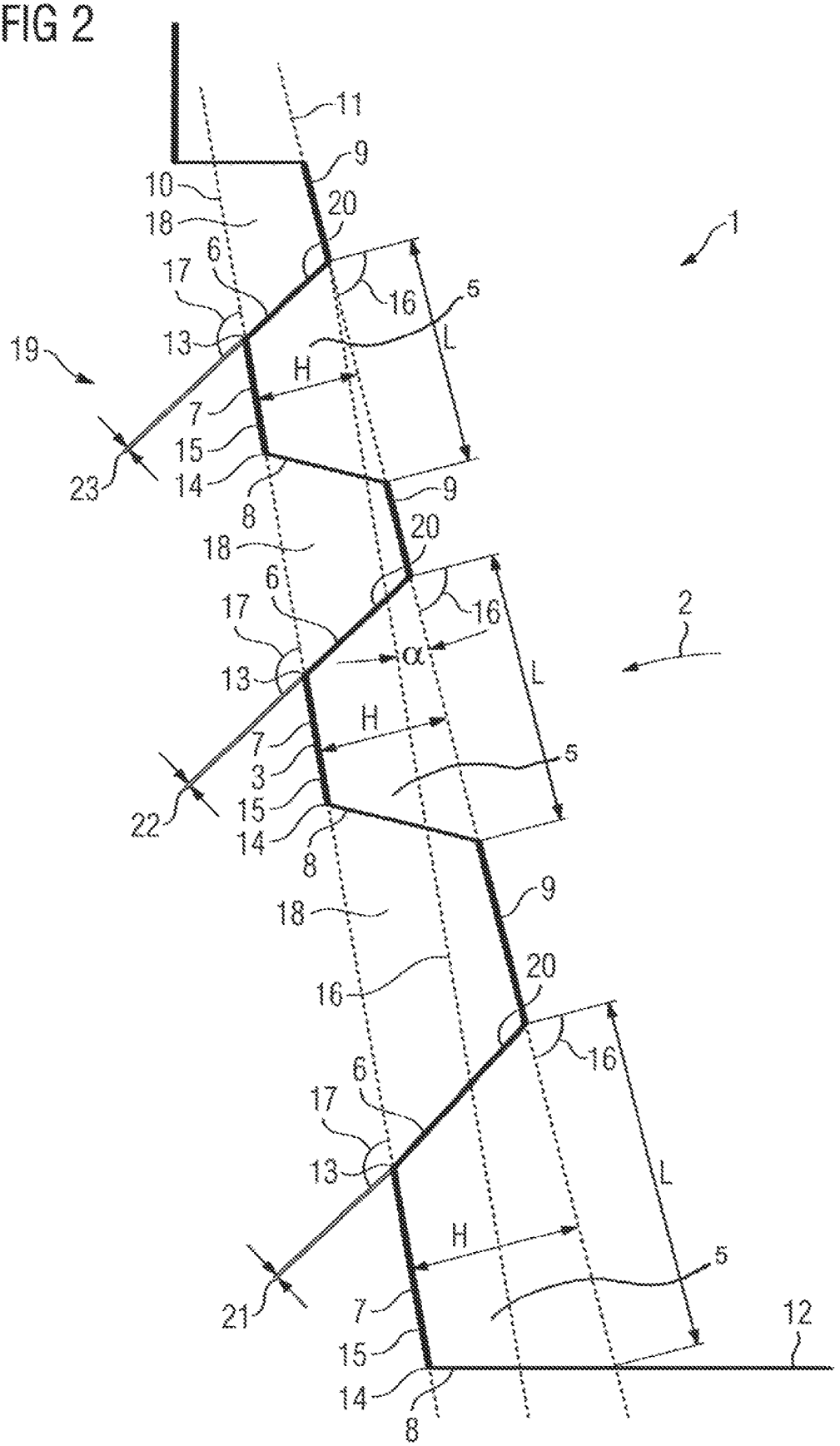
FIG. 2 shows a blade root fastening according to the invention.

FIG. 2 shows a blade root 1 which is constructed according to the invention. For the sake of clarity, only the contour of the blade root 1 in the leading region 3 is shown. The trailing region 4 could be correspondingly symmetrically constructed. The difference to the blade root 1 according to the prior art shown in FIG. 1 is, inter alia, that the height H of the anchoring teeth 5 increases towards the blade tip 12.

The form of the anchoring teeth 5 shown in FIG. 2 is constructed essentially in a trapezoidal shape, i.e. such that the ascending flank 6 and the descending flank 8 are each constructed as a straight line. The anchoring-tooth apex 7 and the anchoring-tooth trough apex 9, as to be seen in FIG. 2, lie on a straight line. In alternative embodiments, the anchoring teeth can be of a wave-like design, as is shown in FIG. 1. The height H, in the selected exemplary embodiment according to FIG. 2, is determined approximately from the middle of the straight line, upon which the anchoring-tooth apex 7 is arranged, to the trough straight line 11. The height H could also be easily determined in a front transition region 13 or from the rear transition region 14 to the trough straight line 11.

The blade root 1 according to FIG. 2 is constructed as a firtree root, which is not shown in more detail in FIG. 2. The anchoring-tooth apexes 7 lie on an anchoring-tooth flank 15 which is formed essentially parallel to the apex straight line 10. In the exemplary embodiment according to FIG. 2, the anchoring-tooth flanks 15 lie on the apex straight line 10. The trough straight line 11 and the apex straight line 10 are arranged at an angle $\alpha$ which lies between 2° and 10° to each other. For illustrating the angle $\alpha$, an auxiliary straight line 30 is shown in FIG. 2 and is arranged parallel to the apex straight line 10. The angle $\alpha$ can have angles between 1° and 12° in alternative embodiments. The blade root 1 has a blade root tip 12 which is formed at the end in relation to a rotational axis of the rotor 19. The blade root 1 has at least two anchoring teeth 5 arranged in series along an extent pointing towards the blade root tip 12.

In addition to the height H of the anchoring teeth 5, the length L of the anchoring teeth 5, moreover, is varied towards the blade tip 12. The length L of the anchoring tooth 5 according to FIG. 2 is determined from the intersection point between the ascending flank 6 and the trough straight line 11 and the intersection point of the descending flank 8 and the trough straight line 11. As is to be seen in FIG. 2, the length of the anchoring teeth 5 increases towards the blade tip 12.

The front transition region 13 and/or the rear transition region 14 can be rounded by radii.

The blade root 1 is fitted in a blade groove 18 in a rotor 19. This means that the flank 6 of the respective anchoring teeth 5 bears against a load-bearing flank 20.

A flank 6 is formed between the anchoring-tooth trough apex 9 and the anchoring-tooth apex 7. An inner notch radius 16 is formed between the anchoring-tooth trough apex 9 and the flank 6. Furthermore, an outer notch radius 17 is formed between the flank 6 and the anchoring-tooth apex 7, wherein the outer notch radius 17 is smaller than the inner notch radius 16. This leads to optimum distributions of stress paths. In the transition region 14, an outer notch radius 17 or inner notch radius 16 is therefore formed, being different according to the invention. In a first variant, the outer notch radius 17 is smaller than the inner notch radius 16. In a second variant, the outer notch radius 17 can be larger than the inner notch radius 16.

Furthermore, the outer notch radius 17 is such that this increases towards the blade tip 12. This means that the outer notch radius 17 increases from anchoring tooth 5 to anchoring tooth 5 towards the blade root tip 12. By the same token, the inner notch radius 16 is formed in such a way that this increases from anchoring tooth 5 to anchoring tooth 5 towards the blade root tip 12.

The inner notch radius 16 in alternative embodiments can be formed in such a way that it decreases from anchoring tooth 5 to anchoring tooth 5 towards the blade root tip 12. By the same token, in an alternative embodiment, the outer notch radius 17 can be formed in such a way that it decreases from anchoring tooth 5 to anchoring tooth 5 towards the blade root tip 12.

The blade root 1, furthermore, is designed in such a way that the flank 6 bears against a corresponding load-bearing flank 20 in the blade groove 18. A load-bearing flank clearance 21, 22, 23 is therefore formed between the flank 6 and the load-bearing flank 20. For optimum distribution of the stress paths, the load-bearing flank clearance 21, when the blade root 1 is being installed, is initially designed in such a way that the anchoring tooth 5 which is closest to the blade root tip 12 bears directly against the load-bearing flank 20. This means that contact exists between the flank 6 and the load-bearing flank 20. In this variant, the blade root 1 is designed in such a way that the load-bearing flank clearances 22 and 23 become larger. This means that away from the blade root tip 12 the load-bearing flank clearances 22 and 23 of the anchoring teeth 5 formed towards the blade airfoil increase.

In a first alternative embodiment, the load-bearing flank clearances 22 and 23 are designed to be equal.

In further alternative embodiments, the load-bearing flank clearance 23 is designed in such a way that there is basically no load-bearing flank clearance 23. This means that during installation the anchoring tooth 5 which corresponds to the load-bearing flank clearance 23 is in contact. The load-bearing flank clearances 22 and 21 increase towards the blade root tip 12 in this alternative embodiment.

In a further alternative embodiment, the anchoring tooth 5 which corresponds to the load-bearing flank clearance 22 is in contact, wherein the load-bearing flank clearances 21 and 23 differ from zero.

The invention claimed is:

1. A turbine blade fastening, comprising:
a blade root;
a blade airfoil; and
a blade groove,
wherein the blade root is arranged in the blade groove,
wherein the blade root comprises at least two anchoring teeth which are designed for fitting into corresponding recesses in a rotor,
wherein the blade root has a blade root tip formed at the end in relation to a rotational axis of the rotor,
wherein the at least two anchoring teeth are arranged in series along an extent pointing towards the blade root tip,
wherein the height of the anchoring teeth increases towards the blade root tip,
wherein an anchoring tooth has a flank between an anchoring-tooth trough apex and an anchoring-tooth apex,
wherein an outer notch radius is formed between the flank and the anchoring-tooth apex,
wherein an inner notch radius is formed between the anchoring-tooth trough apex and the anchoring-tooth apex,
wherein the outer notch radius is smaller than the inner notch radius, and
wherein a load-bearing flank clearance is formed between the flank and a corresponding load-bearing flank in the blade groove, and
wherein there is basically no load-bearing flank clearance on the anchoring tooth which is closest to the blade root tip, and the load-bearing flank clearances between a plurality of further flanks and corresponding load-bearing flanks increase towards the blade airfoil.

2. The turbine blade fastening as claimed in claim 1, wherein the blade root is designed as a firtree root.

3. The turbine blade fastening as claimed in claim 1, wherein the anchoring teeth have in each case an anchoring-tooth apex and the anchoring-tooth apexes are arranged essentially along an apex straight line.

4. The turbine blade fastening as claimed in claim 3,
wherein the turbine blade root has an anchoring-tooth trough apex between the anchoring teeth, and
wherein the anchoring-tooth trough apexes are arranged essentially along a trough straight line.

5. The turbine blade fastening as claimed in claim 4, wherein the apex straight line and the trough straight line are arranged at an angle $\alpha$ of between 220 and 1020 to each other.

6. The turbine blade fastening as claimed in claim 1, wherein the length of the anchoring teeth increases towards the blade root tip.

7. The turbine blade fastening as claimed in claim 1, wherein the outer notch radius increases towards the blade root tip.

8. The turbine blade fastening as claimed in claim 1, wherein the inner notch radius increases towards the blade root tip.

* * * * *